US006189246B1

(12) United States Patent
Gorthala

(10) Patent No.: US 6,189,246 B1
(45) Date of Patent: Feb. 20, 2001

(54) THREE DIMENSIONAL ADVERTISING BILLBOARD

(76) Inventor: Ravi Gorthala, 435 Haw Creek Mews Dr., Asheville, NC (US) 28805

( * ) Notice: Under 35 U.S.C. 154(b), the term of this patent shall be extended for 0 days.

(21) Appl. No.: 09/361,524

(22) Filed: Jul. 27, 1999

(51) Int. Cl.[7] ..... G09F 3/04
(52) U.S. Cl. ..... 40/446; 40/427; 40/624
(58) Field of Search ..... 40/427, 446, 470, 40/509, 546, 579, 624; 446/118

(56) References Cited

U.S. PATENT DOCUMENTS

| | | | | |
|---|---|---|---|---|
| D. 270,317 | | 8/1983 | Fleming | D6/177 |
| 1,412,692 | * | 4/1922 | Linden | 40/446 |
| 2,955,563 | * | 10/1960 | Klinck et al. | 40/446 X |
| 4,271,620 | | 6/1981 | Vicino et al. | 40/406 |
| 4,369,591 | | 1/1983 | Vicino | 40/610 |
| 4,536,980 | | 8/1985 | Fleming | 40/427 |
| 4,654,989 | | 4/1987 | Fleming | 40/427 |
| 5,343,644 | * | 9/1994 | Fleming | 40/446 |
| 5,398,170 | * | 3/1995 | Lee | 40/579 X |
| 5,555,163 | * | 9/1996 | Pisani | 40/452 X |
| 5,644,860 | * | 7/1997 | Piper et al. | 40/579 |

* cited by examiner

*Primary Examiner*—Brian K. Green
(74) *Attorney, Agent, or Firm*—Evenson, McKeown, Edwards & Lenahan, P.L.L.C.

(57) ABSTRACT

A versatile three-dimensional billboard capable of remote control operation, animation, and color accentuation. The billboard includes a board defining a plurality of holes arranged in a matrix. A plurality of rods are slidably mounted in the holes. At least one actuator is operatively coupled to the rods, the actuator being capable of moving each of the rods independently of the other rods. A controller is coupled to the actuator, the controller being operable to move the rods to desired positions such that outer ends of said rods define a three-dimensional display. This billboard has a broad range of uses, for example from a corner grocery store display to a giant advertising billboard at a major downtown location such as Times Square in New York City.

18 Claims, 3 Drawing Sheets

THREE DIMENSIONAL ADVERTISING BILLBOARD

FIELD OF THE INVENTION

This invention relates to a method and an apparatus for billboard advertising, and more specifically to billboard advertising via three-dimensional billboards.

BACKGROUND AND SUMMARY OF THE INVENTION

Billboard advertising is a great marketing tool. The underlying requirement for a billboard is that it should be strikingly attractive and should capture the attention of the prospective customer. Billboards are predominantly two-dimensional. Most two-dimensional billboards such as posters are labor-intensive to change the advertisement every time depending upon where they are located (high upon on a tower or a building or in the middle of a busy intersection). Automation and remote operation are not available to most two-dimensional billboards. However, electronic billboards with remote operation capability are becoming popular now. Indeed electronic billboards may be attractive. But, they cannot portray realistic images (other than giant TV screens), especially three-dimensional images, which would be very effective.

Adding a third dimension to a billboard accentuates its utility and appearance. Three-dimensional billboards do exist, such as inflatable billboards and foam billboards. For example, U.S. Pat. No. 4,369,591 and U.S. Pat. No. 4,271,620 disclose three-dimensional billboards. However, those known three-dimensional billboards do not have some of the most desirable features of billboards, which are (1) the versatility to change the advertisement easily and/or remotely, and (2) the capability to provide animation. The present invention is able to incorporate all of these desirable features and offers more flexibility to develop a range of three-dimensional billboards.

The present invention stems from a pin screen device, for example as disclosed in U.S. Pat. No. 4,654,989, U.S. Pat. No. 4,536,980, and U.S. Design Pat. No. Des. 270,317. The pin screen device is primarily an entertaining toy for both children and adults. The pin screen toy currently available in stores measures approximately 6"×4"×3". It chiefly comprises two parallel plates with an array (or matrix) of holes in which metal pins can move in and out of the plane of the plates with pin ends forming the three-dimensional figure's surface.

An object of the invention is to provide a three-dimensional billboard which has the versatility to change the advertisement easily and/or remotely, and the capability to provide animation.

This and other objects have been achieved according to the present invention by providing a three-dimensional advertising billboard, including a board having a surface defining a plane. The board defines a plurality of holes arranged in a matrix. A plurality of rods are slidably mounted in the holes such that the rods are movable relative to the plane. At least one actuator is operatively coupled to the plurality of rods. The at least one actuator is capable of moving each of the rods independently of the other rods. A controller is coupled to the at least one actuator. The controller is operable to move the rods to desired respective positions such that outer ends of the rods define a three-dimensional display.

The present invention utilizes multiple innovative features to achieve a versatile three-dimensional billboard. The size of the present three-dimensional billboard varies based on the application of the billboard and the desired viewing range, but is typically much larger than the above-mentioned pin screen toy. The cross-sectional area of the plate can be as small as 1 foot by 1 foot and as big as 100 ft by 100 ft or larger. The diameter and length of the rods and the diameter of the holes receiving the rods are also typically much larger than the metal pins and holes of the pin screen toy (usually about 1/16" in diameter). The rods of the present invention may be made of various materials, for example plastic, foam or metal, which may be either solid or hollow, but are preferably lightweight. The size of the rod is determined by the size of the bill board and the resolution required for the three-dimensional image. The rod may have various cross-sectional shapes, for example circular, hexagonal, or any other shape.

The rods can be moved manually or by a physical mechanism (e.g., mechanical, electromechanical, electromagnetic, electrostatic, thermo-mechanical, phase-change materials, pneumatic, hydraulic, etc.). The rods can be moved from a remote location. The rods can be returned to normal position by providing a spring return mechanism. Also the ends of the rods, i.e., the rod-ends that form the profile of the three-dimensional image, can be monochromatic or multi-colored to produce vivid color three-dimensional displays. The rods can be opaque or transparent. The transparent rods can be fiber optic rods which transmit light.

Other objects, advantages and novel features of the present invention will become apparent from the following detailed description of the invention when considered in conjunction with the accompanying drawings.

DETAILED DESCRIPTION OF THE INVENTION

Figure 1:
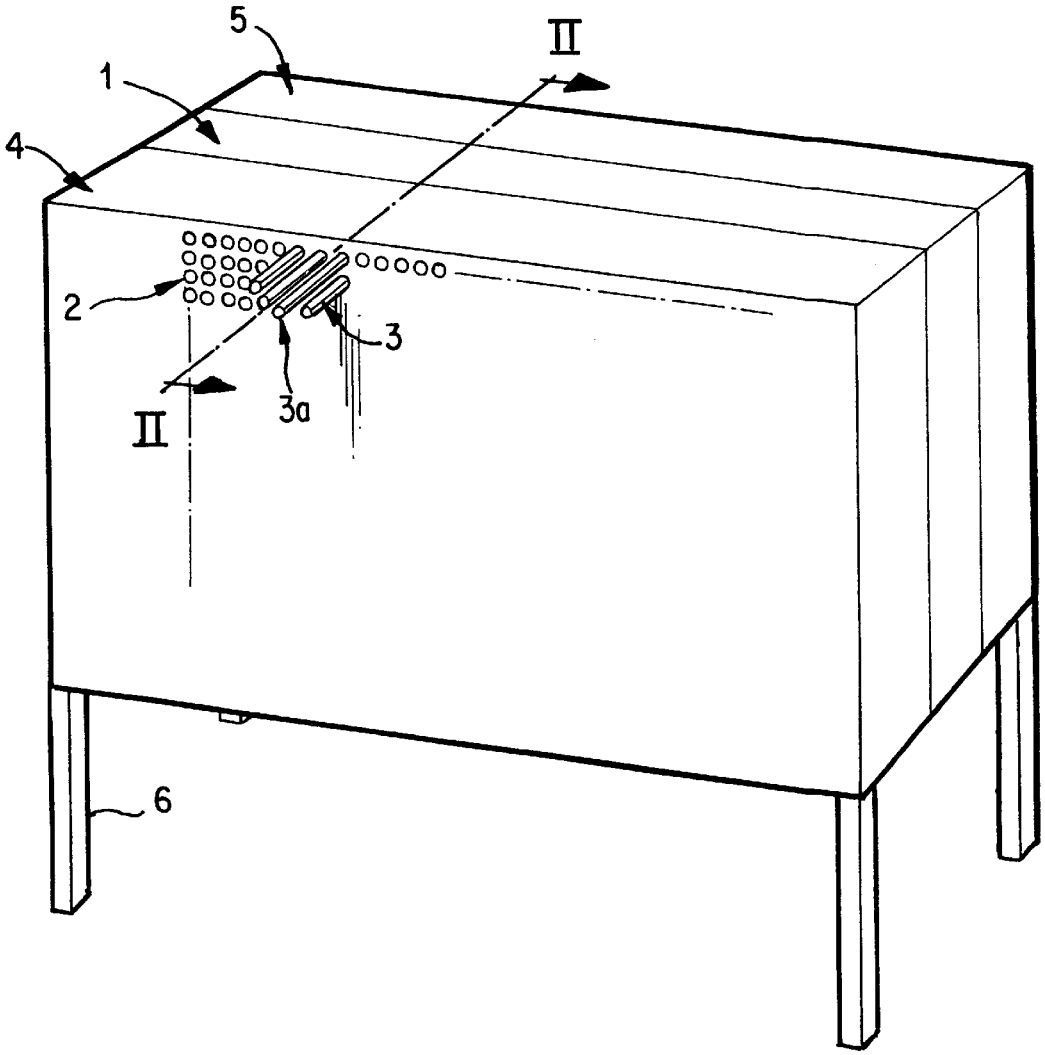
FIG. 1 is a perspective view of a three-dimensional advertising billboard according to a preferred embodiment of the present invention.

As shown in FIG. 1, a framework 1 such as a vertical solid board, which can be made of a light weight material such as foam, plastic or wood, defines a matrix of holes 2. The configuration of the matrix (i.e., the configuration defined by adjacent ones of the holes 2) need not be square, as shown in the illustrated embodiment, but typically should be regular, i.e., the adjacent holes 2 should define a regular polygonal shape, e.g., triangular, square, rectangular, pentagonal, hexagonal, octagonal, etc. The matrix may have the same configuration over the entire surface of the billboard, or the matrix configuration may be varied in different areas of the billboard. For example, it may be desired to have a frame area at the outer periphery of the billboard having a different matrix configuration than that of another area of the billboard inside of the frame area.

Rods 3 are movably disposed in the holes 2, such that the rods 3 can extend out of the plane of the framework 1 by specified distances. The movement of the rods 2 is restricted in any other direction than the board depth. In the embodiment illustrated in FIG. 2, the diameter of the outer rod-end 3*a* is larger than that of the hole 2 and the shaft of the rod 3 passing through the hole 2. This creates a stop which prevents the rod-end 3*a* from being drawn into the interior of the frame 1, helping to keep the rods 3 properly aligned. The opposite inner rod-end 3*b* of the embodiment illustrated in FIG. 2 also is enlarged to create a stop when the rod is moving in the outward direction. The inner rod-end 3*b* abuts the rear side of the framework 1 when the rod is in its outermost position, as shown by rod 3' in FIG. 2.

Alternatively, in the embodiment illustrated in FIG. 1, the diameter of the outer rod-end 3*a* is the same as that of the shaft of the rod 3 passing through the hole 2. This allows the outer rod-end 3*a* to be moved to a position flush with the plane of the frame 1, or to be withdrawn into the hole 2.

Depending upon the application and the desired appearance, the diameter of the rods 3 and the corresponding diameter of the holes 2 may be the same over the entire surface of the billboard, or may be varied if desired, for example, to achieve a frame area at the outer periphery of the billboard having a different appearance than an area interior thereof.

The rods 3 can be hollow or solid, and may have any desired cross-section (e.g., circular, square, hexagonal, etc.). Each outer rod-end 3*a* may be considered to be equivalent to a pixel on a TV or computer screen. The rod ends 3*a* can be transparent or opaque and can be painted with a color of choice. Each of the rod ends 3*a* can be equipped with one or more lamps 12 to achieve a lighted display, as shown at rod 3" in FIG. 2. The lamps may be colored to yield a color pixel. The assembly of the framework 1 with the rods 3 can be housed in enclosures 4 and 5. Enclosure 4 must be transparent to display the three-dimensional surface of the outer rod-ends, while enclosure 5 can be either transparent or opaque. The entire enclosure then can be supported on a support structure 6 to provide the required height for the three-dimensional billboard.

Depending upon the size of the billboard planned and depending upon the resolution required, the number of rods required and spacing between the rods can be determined. Depending on the maximum depth of the three-dimensional figure, lengths of the rods can be determined.

Movement of rods can be achieved in at least the following three different ways:

(1) Moving the individual rods manually.

(2) Moving the rods using a three-dimensional object. For instance, a three-dimensional figure such as a human face, can first be made with foam (plastic) or any other material (e.g., plaster, clay, or sheet metal). Then the foam object can be pressed against the array of rods such that rods move and the three-dimensional object will protrude from the billboard.

(3) Moving the rods automatically via actuators (e.g., mechanical, electromechanical, electromagnetic, electrostatic, thermo-mechanical, phase-change materials, pneumatic, hydraulic, etc.). This method can be used for generating the billboard advertisements remotely.

The first two methods are fairly easy and are less expensive to develop. However, operating costs will be much higher to effect the changes in rod position. The third method, however, will require higher initial costs, but much lower operating costs. The third method can be totally computerized. The third method is described in further detail in the following.

A personal computer (PC) can be used to draw the three-dimensional image that needs to be displayed on the billboard. The dimensions (or coordinates) of each pixel (for each rod) will be known from the three-dimensional drawing. If the computer is equipped with an I/O (Input/Output) control, appropriate control signals can be generated by the computer and input to the actuators. The actuators then move the rods according to the signal they receive. The color of each rod can also be set by the computer. This method can be used not only for changing the billboard display as frequently as possible, but also for display animation. An example of an animation event may be that the three-dimensional human face moves in and out of the screen slowly. Or, the three-dimensional car image moves across the billboard. If the response time of the actuators is small, faster animation of the display is possible. Remote operation can be achieved through a telephone modem line, radiowave/microwave communication or digital satellite linking.

Figure 2:
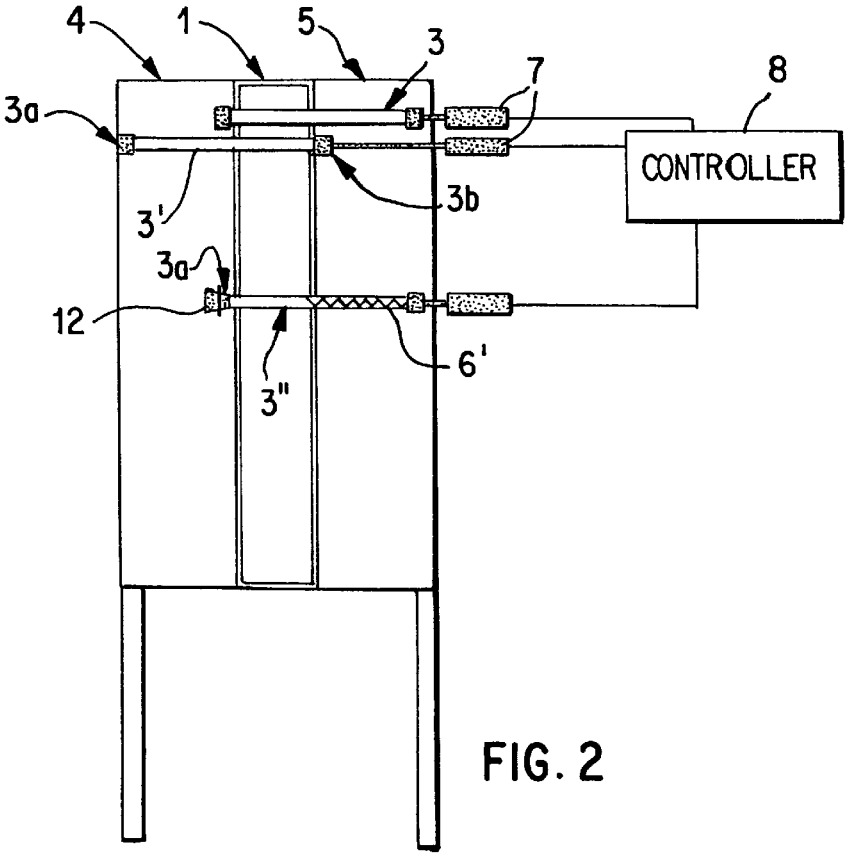
FIG. 2 is a sectional side view taken along a vertical plane X—X of FIG. 1, showing a three-dimensional advertising billboard according to the invention similar to that of FIG. 1.

FIG. 2 shows a sectional side view of a three-dimensional billboard taken along a vertical plane X—X in FIG. 1. The rods 3 are coupled to respective actuators 7, which operate to move the rods to their programmed respective positions relative to their reference which is the surface of the board 1. When the actuators return to their reference position, the rods return to their normal position due to a spring return mechanism 6'. The actuators are controlled via a controller 8. The controller 8 may be a general purpose processor programmed with instructions that cause the processor to control the actuators, specific hardware components that contain hard-wired logic for controlling the actuators, or any other combination of general purpose computer components and custom hardware components. For example, the controller 8 may be a programmable logic controller (PLC), a microprocessor, or a computer. The program in the processor can be accessed and modified remotely via a telephone line and a modem. As mentioned above, the controller 8 may be a personal computer, which can be located remotely from the actuators.

It is desirable for the rods 3 to be continuously variable between an outermost position (as shown at rod 3' in FIG. 2) and an innermost position (as shown at rod 3" in FIG. 2), in order to provide the best resolution and visual effect. However, depending upon the type of controller 8 and/or actuator 7 that is used, it may not be possible to continuously vary the movement of the rods 3. Continuous variability of the position of the rods 3 is not necessary, as long as there are several step-wise incremental positions between the outermost position and the innermost position. In another embodiment, a single actuator can move the rods one at a time in a programmed sequence. In this method, animated three-dimensional display is not possible. In yet another embodiment using a single actuator, the actuator can move a three-dimensional object which will in turn push multiple rods simultaneously. In this approach, animated display can be achieved.

Figure 3:
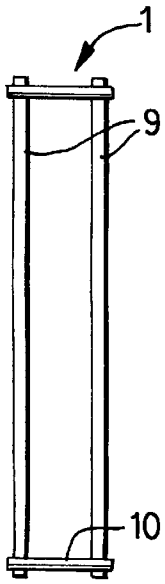
FIG. 3 is a detail view of a preferred embodiment of the framework that supports the movable rods.

FIG. 3 shows another embodiment for constructing the framework or board 1 that houses the rods. It can be constructed using two thin plates 9 (e.g., plastic, foam, metal or plywood) that are separated by the required distance that prevents the movement of the rods in any other direction than the depth of the board. The plates 9 can be held together by appropriate fastening members 10.

Figure 4:
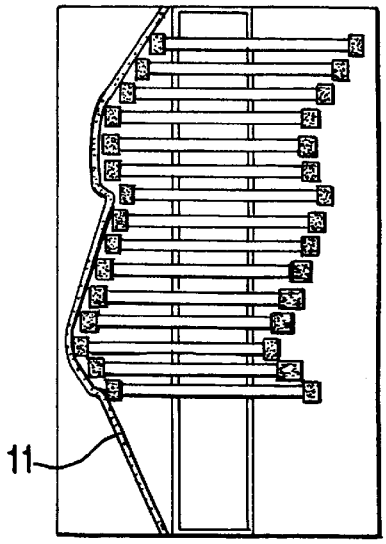
FIG. 4 is a sectional side view similar to that of FIG. wherein an elastic membrane is placed in front of the rod-ends.

FIG. 4 shows another embodiment of the invention. In this embodiment, the rod ends 3*a* push against an elastic membrane 11 such as rubber. This feature will provide smooth three-dimensional profile. The membrane can be opaque and painted with a desired color or can be translucent to transmit light, if desired.

Figure 5:
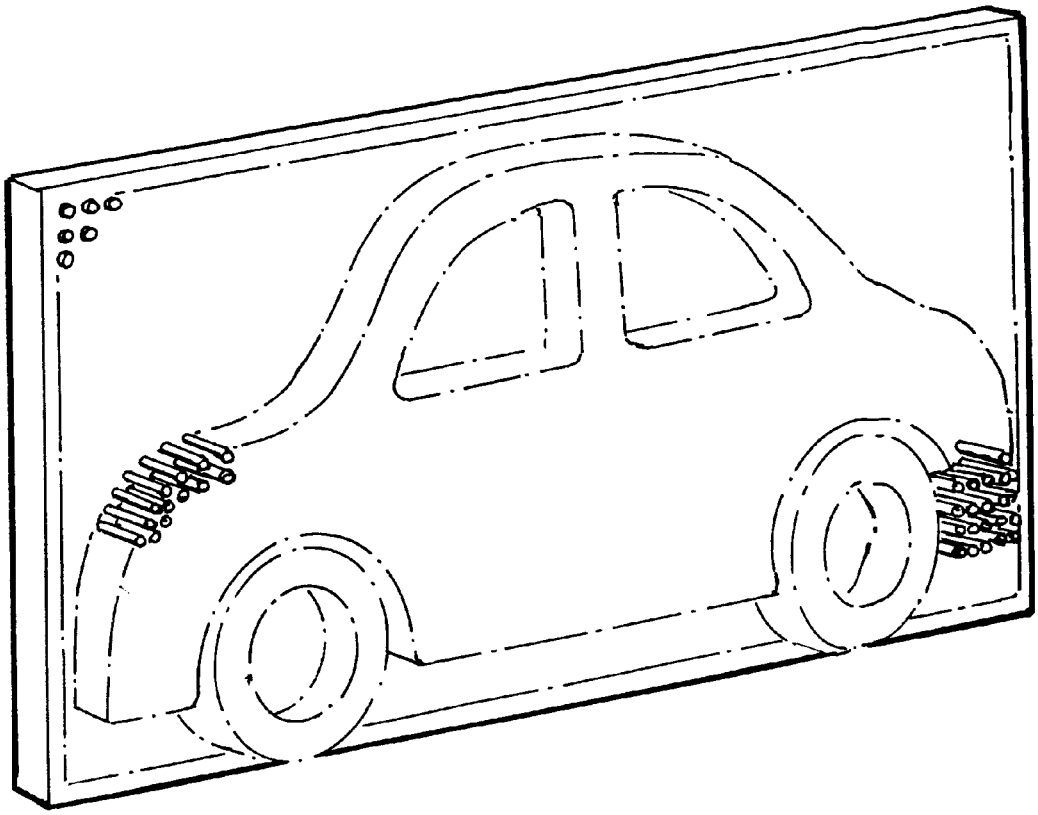
FIG. 5 is a perspective view of an example of a three-dimensional profile of a car on a three-dimensional advertising billboard according to the present invention.

FIG. 5 shown an example of a three-dimensional profile of a car on a billboard from a CAD (computer-aided-design) three-dimensional rendering.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method of providing a three-dimensional display for advertisements on billboard signs, comprising the steps of:

moving a plurality of rods located in matrix to respected positions relative to a vertical plane wherein said rods are moved by actuators;

controlling said actuators by a computer, said actuators being controlled based on a three-dimensional computer aided drawing in said computer, said computer producing input/output control signals to move the rods.

2. A method according to claim 1, wherein ends of said rods that make the three-dimensional display are monochromatic.

3. A method according to claim 1, wherein ends of said rods that make the three-dimensional display are multicolored.

4. A method according to claim 1, wherein ends of said rods are illuminated with at least one light.

5. A method according to claim 4, wherein said at least one light is colored.

6. A method according to claim 4, wherein said at least one light is selected from the group consisting of conventional lamps, light-emitting-diode lamps, and fiber optic light.

7. A method according to claim 1, wherein the three-dimensional display is animated.

8. A method according to claim 1, wherein an elastic membrane is arranged at ends of the rod to provide a smooth three-dimensional profile.

9. The method according to claim 1, further including the step of providing each of said rods with a light emitting diode lamp in order to provide a three-dimensional color display.

10. A method of providing a three-dimensional display on an advertising billboard, said method comprising:

providing a board having a surface defining a plane, said board defining a plurality of holes arranged in a matrix;

slidably mounting a plurality of rods in said holes such that said rods are movable relative to said plane;

operatively coupling at least one actuator to said plurality of rods, said at least one actuator being capable of moving each of said rods independently of the other rods; and coupling a controller to said at least one actuator, said controller being operable to move said rods to desired respective positions such that outer ends of said rods define a three-dimensional display, wherein said actuators are selected from the group consisting of electromechanical actuators, electromagnetic actuators, electrostatic actuators, thermo-mechanical actuators, pneumatic actuators, and hydraulic actuators.

11. A method according to claim 10, further comprising arranging a light at an outer end of at least some of said rods.

12. A method according to claim 10, further comprising arranging an elastic membrane to cover outer ends of the rods.

13. A three-dimensional advertising billboard, comprising:

a board having a surface defining a plane, said hoard defining a plurality of holes arranged in a matrix;

a plurality of rods slidably mounted in said holes such that said rods are movable relative to said plane;

at least one actuator operatively coupled to said plurality of rods, said at least one actuator being capable of moving each of said rods independently of the other rods; and a controller coupled to said at least one actuator, said controller being operable to move said rods to desired respective positions such that outer ends from each of said rods together define a three-dimensional display, wherein said actuators are selected from the group consisting of electromechanical actuators, electromagnetic actuators, electrostatic actuators, thermo-mechanical actuators, pneumatic actuators, and hydraulic actuators.

14. A three-dimensional advertising billboard according to claim 13, further comprising a light at an outer end of at least some of said rods.

15. A three-dimensional advertising billboard according to claim 13, further comprising an elastic membrane arranged covering the outer ends of the rods.

16. A three-dimensional advertising billboard, comprising:

a board having a surface defining a plane, said board defining a plurality of holes arranged in a matrix;

a plurality of rods slidably mounted in said holes such that said rods are movable relative to said plane;

at least one actuator operatively coupled to said plurality of rods, said at lease one actuator being capable of moving each of said rods independently of the other rods; and a controller coupled to said at least one actuator, said controller being operable to move said rods to desired respective positions such that outer ends from each of said rods together define a three-dimensional display, wherein each of said plurality of rods are spring loaded whereby, when said at least one actuator is disengaged, said at least one rod returns to an original position occupied before being moved by said at least one actuator.

17. A three-dimensional advertising billboard, comprising:

a board having a surface defining a plane, said board defining a plurality of holes arranged in a matrix;

a plurality of rods slidably mounted in said holes such that said rods are movable relative to said plane;

at least one actuator operatively coupled to said plurality of rods, said at lease one actuator being capable of moving each of said rods independently of the other rods; and a controller coupled to said at least one actuator, said controller being operable to move said rods to desired respective positions such that outer ends from each of said rods together define a three-dimensional display, each of said plurality of rods further including a means for returning said rod to an original position when said at least one actuator is withdrawn.

18. A method of providing a three-dimensional display on an advertising billboard, said method comprising:

providing a board having a surface defining a plane, said board defining a plurality of holes arranged in a matrix;

slidably mounting a plurality of rods in said holes such that said rods are movable relative to said plane;

operatively coupling at least one actuator to said plurality of rods, said at least one actuator being capable of moving each of said rods independently of the other rods; and coupling a controller to said at least one actuator, said controller being operable to move said rods to desired respective positions such that outer ends of said rods define a three-dimensional display, wherein each of said plurality of rods are spring loaded whereby, when said at least one actuator is disengaged, said rods were returned to an original position before being moved by said at least one actuator.

* * * * *